US010166759B2

(12) United States Patent
Van Wijhe et al.

(10) Patent No.: US 10,166,759 B2
(45) Date of Patent: Jan. 1, 2019

(54) METHOD OF CLEANING OF A PRINTED BAND OF FLEXIBLE MATERIAL, AS WELL AS AN APPARATUS THEREFOR

(71) Applicant: POLYMOUNT INTERNATIONAL B.V., Nijkerk (NL)

(72) Inventors: Christiaan Mark Van Wijhe, Twello (NL); Harmen Van Kesteren, Rhenen (NL)

(73) Assignee: Boers Holding B.V., Nijkerk (NL)

( * ) Notice: Subject to any disclaimer, the term of this patent is extended or adjusted under 35 U.S.C. 154(b) by 0 days.

(21) Appl. No.: 15/582,651

(22) Filed: Apr. 29, 2017

(65) Prior Publication Data

US 2017/0313056 A1 Nov. 2, 2017

(30) Foreign Application Priority Data

May 2, 2016 (NL) ..... 2016719

(51) Int. Cl.

| | |
|---|---|
| ***B41F 35/00*** | (2006.01) |
| ***B08B 1/02*** | (2006.01) |
| ***B08B 1/04*** | (2006.01) |
| ***B41F 23/00*** | (2006.01) |
| ***B41F 23/04*** | (2006.01) |
| ***B41M 7/00*** | (2006.01) |
| *B08B 3/04* | (2006.01) |

(52) U.S. Cl.

CPC ..... *B41F 35/001* (2013.01); *B08B 1/02* (2013.01); *B08B 1/04* (2013.01); *B41F 23/002* (2013.01); *B41F 23/0426* (2013.01); *B41M 7/0009* (2013.01); *B08B 3/041* (2013.01); *B41P 2235/21* (2013.01); *B41P 2235/22* (2013.01)

(58) Field of Classification Search

CPC ..... B41F 35/001
USPC ..... 101/423
See application file for complete search history.

(56) References Cited

U.S. PATENT DOCUMENTS 2,956,300 A * 10/1960 Bruno ..... B41F 23/002 15/309.1
5,289,774 A 3/1994 Stanka
5,614,461 A 3/1997 Itoh et al.
(Continued)

FOREIGN PATENT DOCUMENTS

DE 3712984 A1 11/1988
DE 29703677 U1 8/1997
(Continued)

*Primary Examiner* — Anthony Nguyen
(74) *Attorney, Agent, or Firm* — Shewchuk IP Services, LLC; Jeffrey D. Shewchuk

(57) ABSTRACT

A method for cleaning a printed band of flexible material, in which at least one side printing ink comprises with a device. The device comprises a cleaning organ such as a brush roll, and the method the steps comprises of the contacting of the band which printing ink comprises with a cleaning liquid, and the removal of the printing ink which been brought into contact the cleaning liquid with the cleaning organ to obtain a cleaned band of flexible material.

Before the effective of adhered liquid getting rid of, comprises the device a pair of wiper blades into the direction of transport of the band remotely of one another are located and are for the removal of the cleaning liquid the band at an angle first via an uppermost wiper blade and subsequently via a lowermost wiper blade of the pair fed.

18 Claims, 11 Drawing Sheets

(56) References Cited

U.S. PATENT DOCUMENTS

| | | | | |
|---|---|---|---|---|
| 5,621,939 | A | 4/1997 | Yoshida et al. | |
| 5,652,989 | A | 8/1997 | Chiba et al. | |
| 5,685,043 | A * | 11/1997 | LaManna | B08B 1/007 15/256.5 |
| 6,531,213 | B1 * | 3/2003 | Yoshie | B41M 7/0009 428/336 |
| 2001/0008103 | A1 * | 7/2001 | Gasparrini | B41F 35/00 101/424 |
| 2001/0029860 | A1 * | 10/2001 | Lundin | B41F 35/007 101/424 |
| 2003/0209158 | A1 * | 11/2003 | Porat | B41F 17/007 101/425 |
| 2004/0089179 | A1 * | 5/2004 | Link | B41F 35/00 101/424 |
| 2008/0210256 | A1 | 9/2008 | Kretschmer et al. | |
| 2011/0220147 | A1 * | 9/2011 | Schreiber | B08B 1/02 134/15 |
| 2014/0174472 | A1 | 6/2014 | Ardila | |
| 2014/0174473 | A1 | 6/2014 | Millan | |
| 2016/0076811 | A1 | 3/2016 | Kasai et al. | |

FOREIGN PATENT DOCUMENTS

| | | | |
|---|---|---|---|
| DE | 10007746 | A1 | 8/2001 |
| EP | 0985543 | A2 | 3/2000 |
| EP | 1162518 | A2 | 12/2001 |
| EP | 2832459 | A1 | 2/2015 |
| GB | 291920 | | 6/1928 |
| GB | 2090996 | A | 7/1982 |
| WO | 2007/113492 | A2 | 10/2007 |
| WO | 2015/133642 | A1 | 11/2015 |

* cited by examiner

METHOD OF CLEANING OF A PRINTED BAND OF FLEXIBLE MATERIAL, AS WELL AS AN APPARATUS THEREFOR

The present invention relates to a method for cleaning a printed band of flexible material, wherein the band at at least one side thereof comprises printing ink and is stripped from the printing ink using a device for cleaning the printed band of flexible material, which device comprises a cleaning organ, and which method comprises the steps of

- contacting the band with a cleaning liquid,
- removing the printing ink that has been brought into contact with the cleaning liquid with the cleaning organ yielding a cleaned band of flexible material, and
- removing cleaning liquid from the cleaned band of flexible material.

When printing on a band of flexible material, generally a plastic film, unusable printed film will be produced when setting up the printing process. The setting up comprises the registration of colors for multicolor printing, and/or adapting a color until it has the desired hue. Since the conveying speed of the film past the printing machine is relatively high (e.g. 1 m/sec) and the setting up will take relatively long, large amounts of rejected printed film will ensue. It is known in the art to clean the printed band, for instance from U.S. Pat. No. 2014174473 and U.S. Pat. No. 5,289,774.

A first problem is that the cleaning may not be sufficient, i.e. ink residue may remain on the band. A second problem is that it is undesirable if cleaning liquid remains, in particular in case the band is subsequently printed on again.

The object of the present invention is to reduce at least one of both problems.

To this end, a method according to the preamble is characterized in that the device comprises a pair of wiper blades for removing the cleaning liquid wherein the wiper blades

- are arranged at both sides of the band and protrude to beyond the band at each longitudinal edge of the band,
- are situated at a location where the band can be fed at an angle of at least 20° with the horizontal between the wiper blades of the pair of wiper blades, and
- are arranged in the direction of transport of the band at a distance of at least 1 cm from one another in order to get rid of the of cleaning liquid thereof such that the band is first fed along a wiper blade arranged above the band and situated relatively low and subsequently along a wiper blade of the pair of wiper blades arranged below the band and situated relatively high;
- wherein for the removal of the cleaning liquid the band is fed between the pair of wiper blades.

By using a device with the arrangement of the pair of wiper blades as described above, the cleaning liquid is removed from the band more effectively. The angle is preferably at least 40'.

The wiper blades will generally be made of an elastomer material.

The cleaning organ is for instance an ultrasonic cleaning organ or is a scraping organ such as for instance a brush or a sponge roll. The term band of flexible material comprises a flexible plate such as a printing plate, but will generally and preferably be a foil (film) which will usually be of plastic.

The distance in the direction of transport of the wiper blades is preferably at least 2 cm and more preferably at least 4 cm. With a larger distance problems such as one or more of i) stretching of the band, ii) the formation of folds and iii) tearing of the band can be avoided or limited, whereas nevertheless liquid at the particular surface of the band can be removed in a highly effective way.

The angle is the angle of the band between the wiper blades of a pair of wiper blades. The distance between the wiper blades and the relative height refer to the contact lines of the wiper blades with the band (i.e. the elongated portions of the wiper blades that are in contact with the band).

Contacting the band with a cleaning liquid is done for instance by means of spraying.

According to a favourable embodiment, contacting the band with cleaning liquid comprises feeding the printed band through a bath with cleaning liquid.

Thus, the duration of the contact can be prolonged and/or the intensity of the contact can be increased (the liquid can penetrate to a greater degree), thus facilitating the removal of ink from the band.

According to a favourable embodiment, the cleaned band is rolled up after removing the cleaning liquid.

Such a roll can be used for printing.

According to a favourable embodiment, the cleaning organ is a rotating scraping organ and there is a speed difference between the printed band and the scraping organ.

The scraping organ is for instance a brush roll. This brush roll can deliver removed ink to the bath in a highly effective way. The direction of rotation of the rotating scraping organ is preferably such that, at the location where the scraping organ is in contact with the printed band, it moves in a direction opposite to that of the printed band. Thus, the speed at which the scraping organ moves over the surface of the printed band can be increased as a result of which the printed band can be freed of ink to a greater degree.

According to a favourable embodiment, the throughput speed of the band is coupled to the circumferential speed of the rotating scraping organ.

Thus, the scraping will take place independently from the throughput speed of the band of flexible material and effective scraping will take place at every speed. The coupling can be accomplished by coupling the rotating scraping organ with a motor with which the printed band is fed through the bath, or by coupling the rotating scraping organ with a guiding roll used for feeding the printed band through the bath. Here, use can be made of a mechanical coupling such as by means of gear wheels, a chain or the like. Alternatively, the rotating scraping organ can be powered by a motor of its own, wherein the speed is regulated depending on the throughput speed of the printed band.

According to a favourable embodiment, the band obtained after removal of the cleaning liquid using wiper blades is contacted at both sides with additional liquid, and that the device comprises an additional pair of wiper blades for removing the additional liquid wherein the wiper blades

- are arranged at both sides of the band and protrude to beyond the band at each longitudinal edge of the band,
- are situated at a location where the band can be fed at an angle of at least 20° with the horizontal between the wiper blades of the further pair of wiper blades and
- are arranged in the direction of transport of the band at a distance of at least 1 cm from one another in order to get rid of the of cleaning liquid thereof such that the band can first be fed along a wiper blade arranged above the band and situated relatively low and subsequently along a wiper blade arranged below the band and situated relatively high,
- wherein for the removal of the cleaning liquid the band is fed between the further pair of wiper blades.

Thereby, ink residue can be removed from the band to even a greater extent. The angle is preferably at least 40°.

The additional liquid is for instance cleaning liquid. The contacting can for instance be done by spraying or by feeding the band through a second bath (meaning to include a compartment of the earlier bath as well). This second bath may for instance contain cleaning liquid as the additional liquid, which is relatively clean. This cleaning liquid may be brought continuously or non-continuously to the bath situated upstream, from which then liquid with a high level of ink is discharged. Thus, the pollution of cleaning liquid into the first bath is substantially less important, and the concentration thereof is allowed to increase. This makes the disposal thereof cheaper and/or the filtering easier. Further, in this way the consumption of cleaning liquid can be limited while achieving an excellent cleaning.

According to a favourable embodiment, the additional liquid is at least 96 v/v % water, preferably 98.5 v/v % water and more preferably 99.8 v/v % water.

Thus, a better drying is attained because less low-volatile components will be present and thus a faster/better drying can be attained and/or after drying less chemicals will remain on the resulting film. Preferably, the additional liquid is calcium depleted water such as demineralised water, reverse osmosis water or distilled water.

According to a favourable embodiment, the wiper blades selected from wiper blades and/or from additional wiper blades are situated at a location where the band is fed at an angle of at most 87°, preferably at most 82°, and more preferably at most 75° with the horizontal between the wiper blades.

Hence, the likelihood is reduced that liquid is transferred by the wiper blade from one side of the band to the other side. Thus, liquid is effectively removed from the band on both sides of the band.

According to a favourable embodiment, the band after the removal of adhering liquid is subjected to a step of drying using air.

In this way any remaining adhering liquid is removed to a greater extent and the printability of the resulting band is improved. The airflow is for instance a heated airflow.

According to a favourable embodiment, the band obtained after getting rid of the cleaning liquid is printed on.

The cleaned band is highly suitable as a material for setting up a printing process. To this end a band of virgin material can be connected by conventional means with a cleaned band, wherein the cleaned band is used for setting up the printing process. Connecting bands is a technique that is generally applied.

Finally, the present invention relates to device for cleaning a printed band, which device

- comprises a frame,
- comprises a motor for passing the printed band, through the device and
- comprises a cleaning organ for removing printing ink from the printed band to obtain a cleaned band;
- wherein the device comprises a pair of wiper blades for the removal of the cleaning liquid wherein the wiper blades
  - are arranged at both sides of the band and protrude to beyond the band at each longitudinal edge of the band,
  - are situated at a location where the band can be fed at an angle of at least 20° with the horizontal between the wiper blades, and
  - are arranged in the direction of transport of the band at a distance of at least 1 cm from one another in order to get rid of the of cleaning liquid thereof such that the band can first be fed along a wiper blade arranged above the band and situated relatively low and subsequently along a wiper blade arranged below the band and situated relatively high.

Thus, the cleaned band can be freed effectively and to a large extent of adhering liquid. Therefore, the device comprises for instance a bath and the pair of wiper blades is arranged above the bath for letting flow back therein the adhering liquid blocked by the pair of wiper blades. The invention also relates to any embodiment in any combination as described in the dependent method claims, which for the sake of brevity only are not repeated.

The angle is preferably at least 40°.

According to a favourable embodiment, the device comprises an air knife for drying, downstream of the pair of wiper blades, of the cleaned band.

Thus, the cleaned band can be stripped from adhering liquid even more effectively. The air knives are arranged such that they will blow air in a direction opposite to the direction of travel of the cleaned band.

The present invention will now be illustrated with reference to the drawing where FIG. 1*a* show a device 100 according to the invention for cleaning a printed band 195 of flexible material, in short film 195;

FIG. 1*b* shows a perspective view of the apparatus according to FIG. 1A in a state wherein the apparatus is provided with a band of film;

FIG. 1*c* shows a cross-section through the apparatus of FIG. 1B;

Figure 4A:
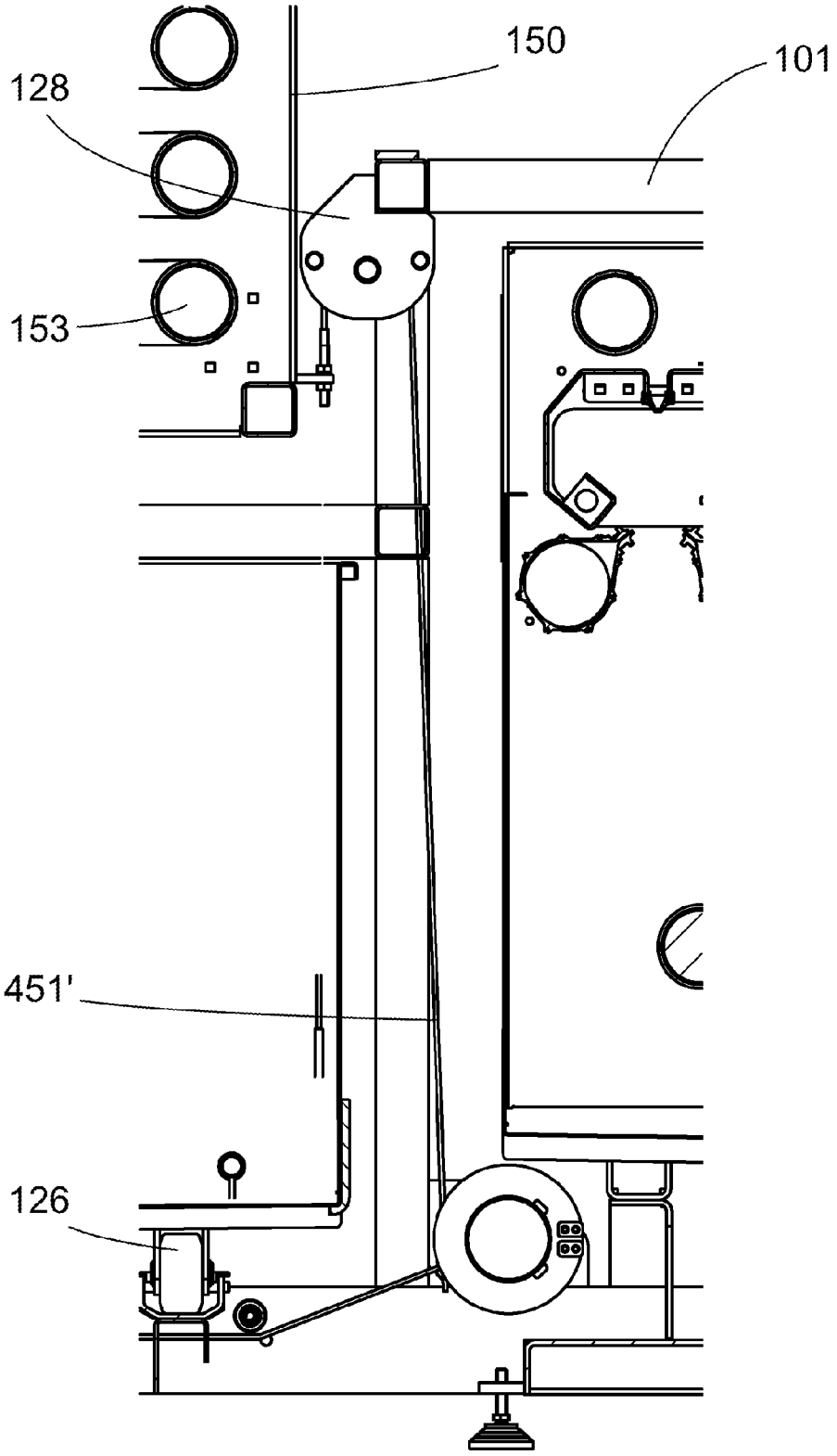
FIG. 4A shows a detail of the longitudinal sectional view of FIG. 1A.
Figure 4B:
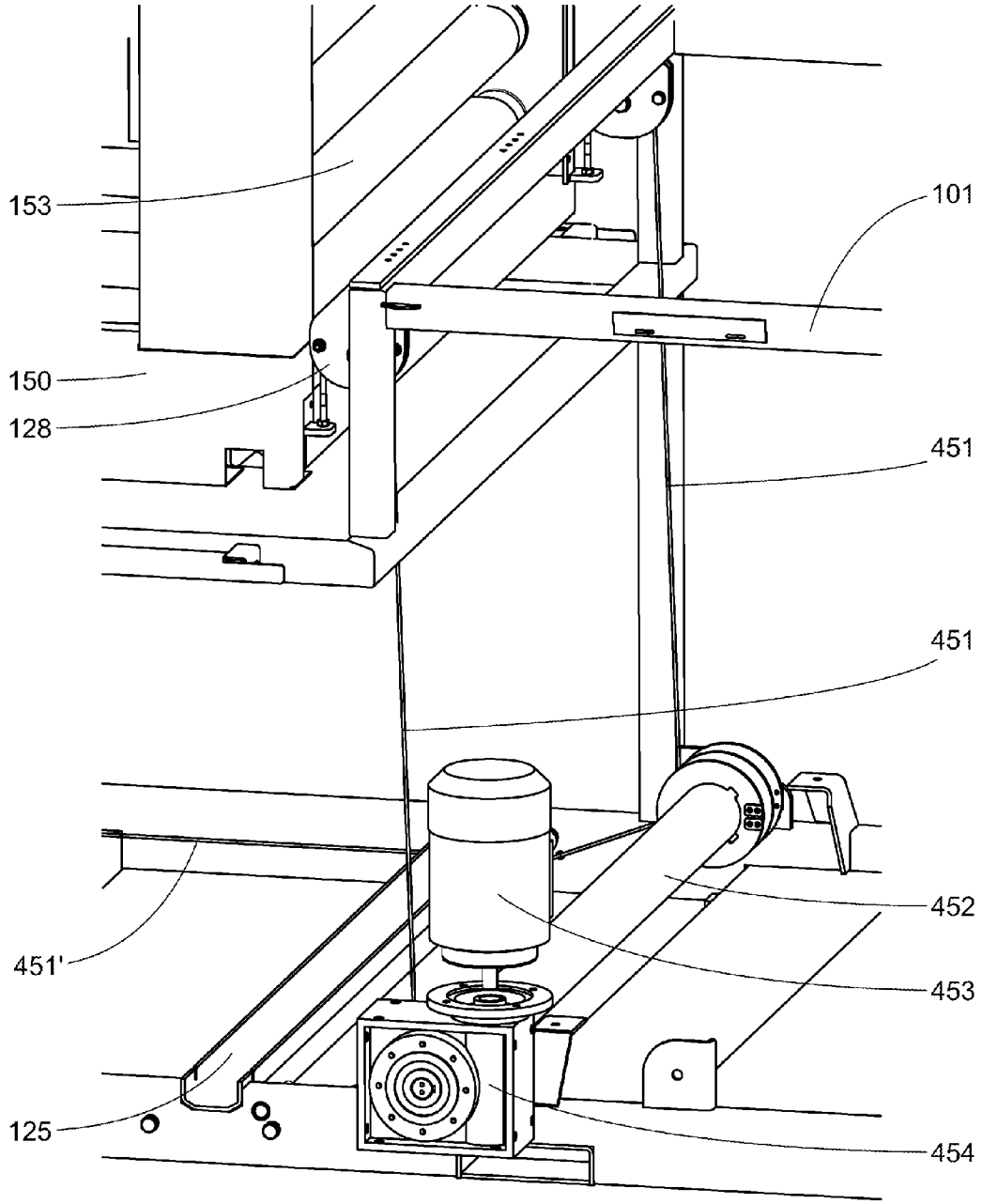
Figure 5A:
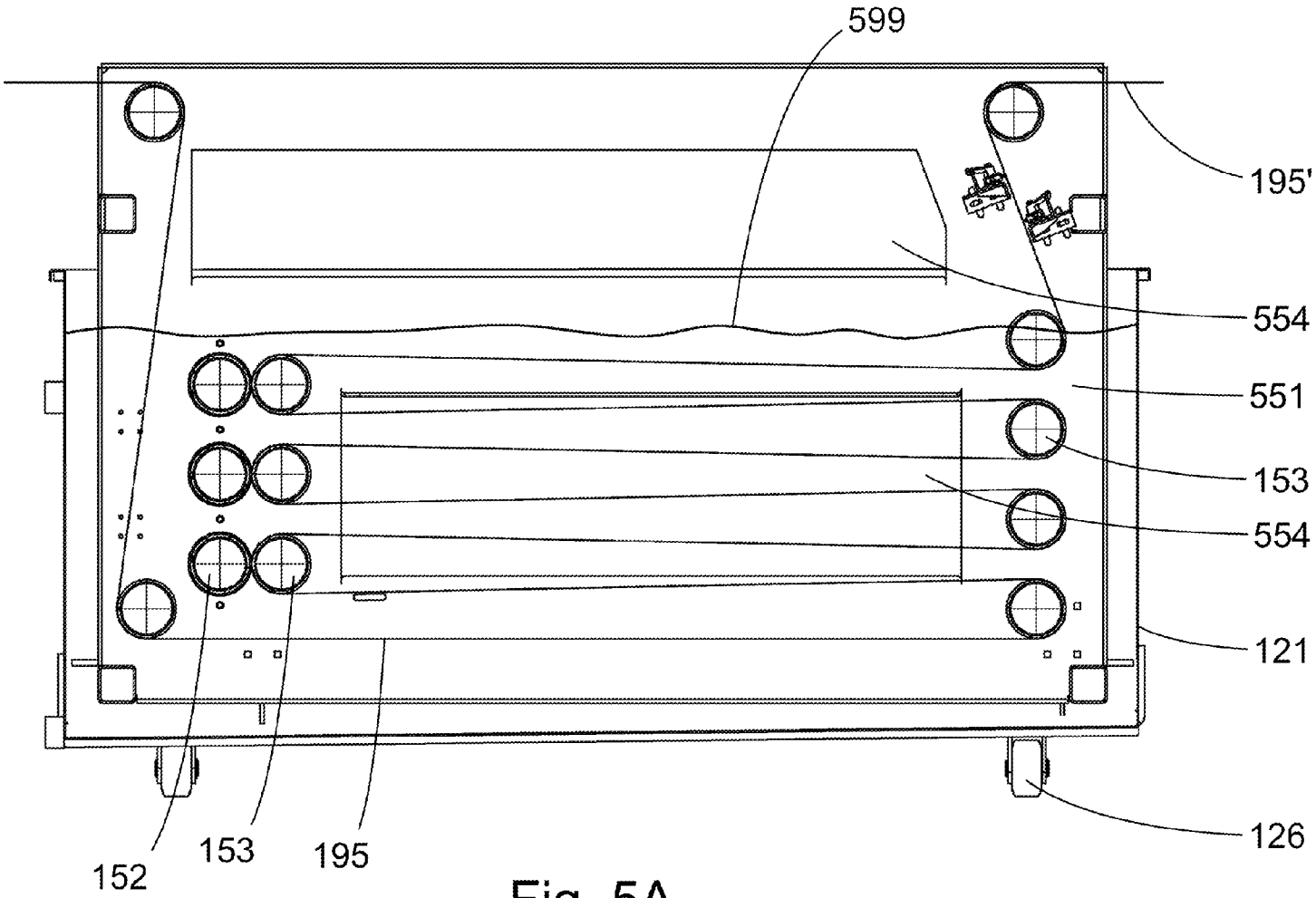
Figure 5B:
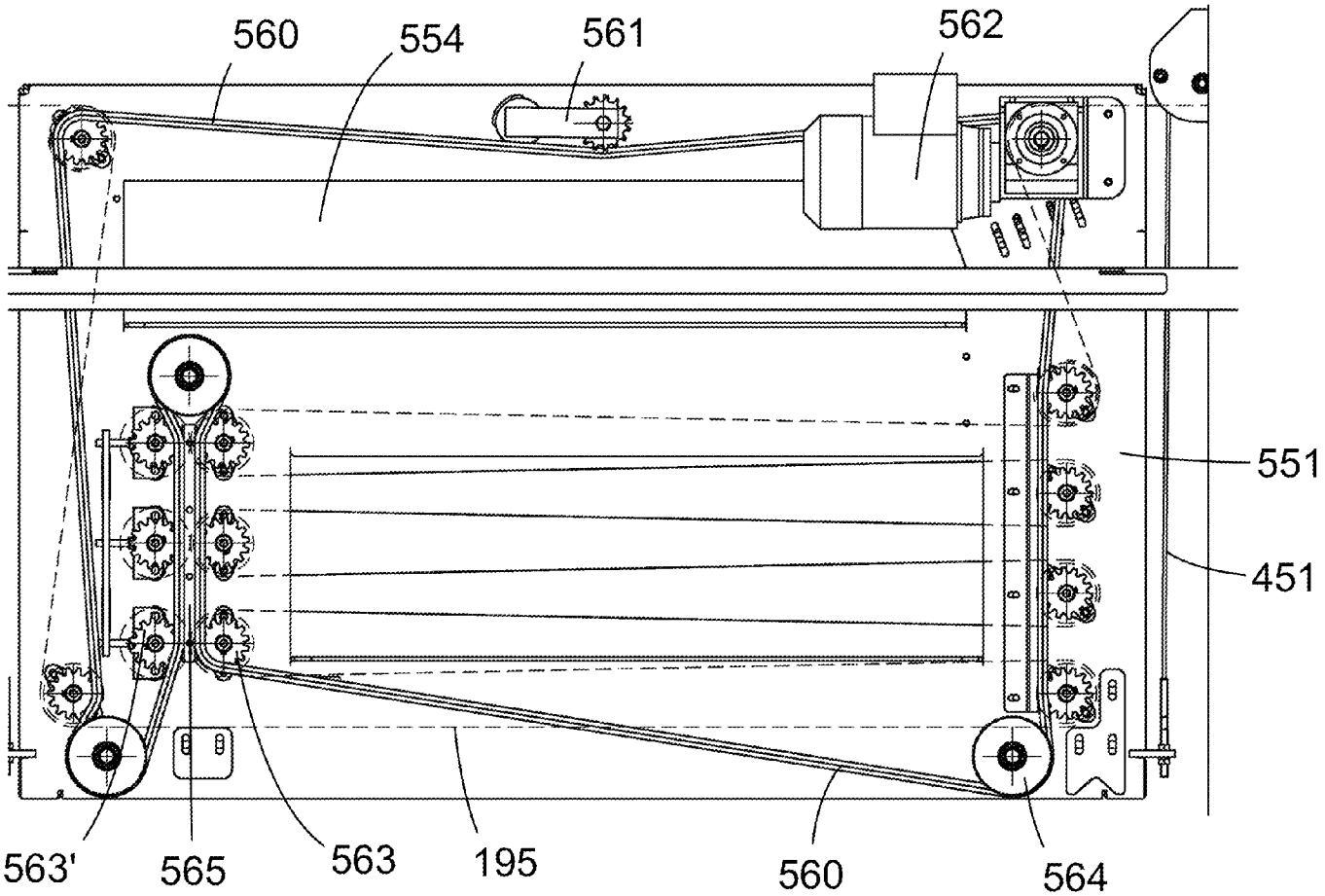
Figure 6:
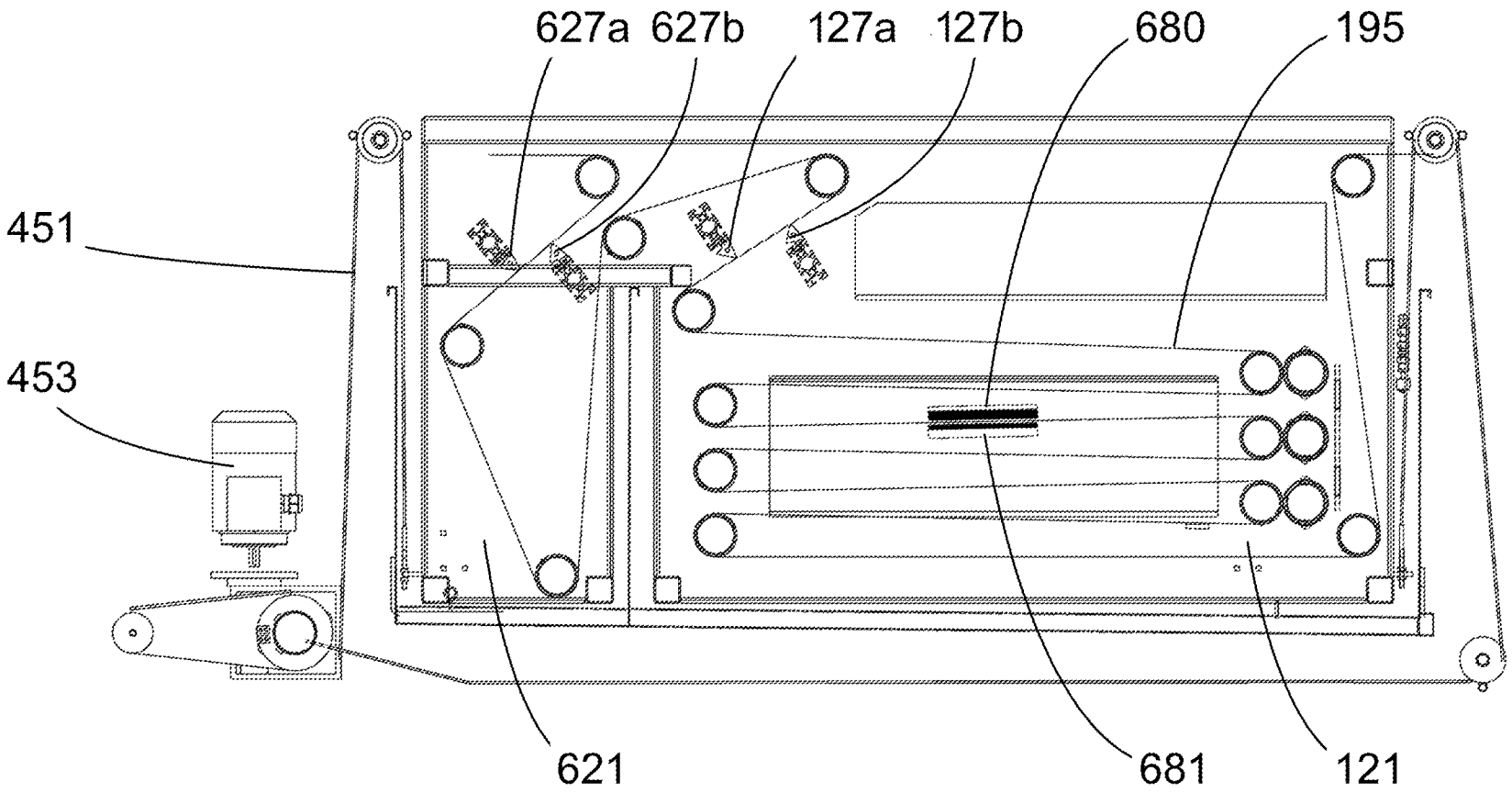
Figure 7A:
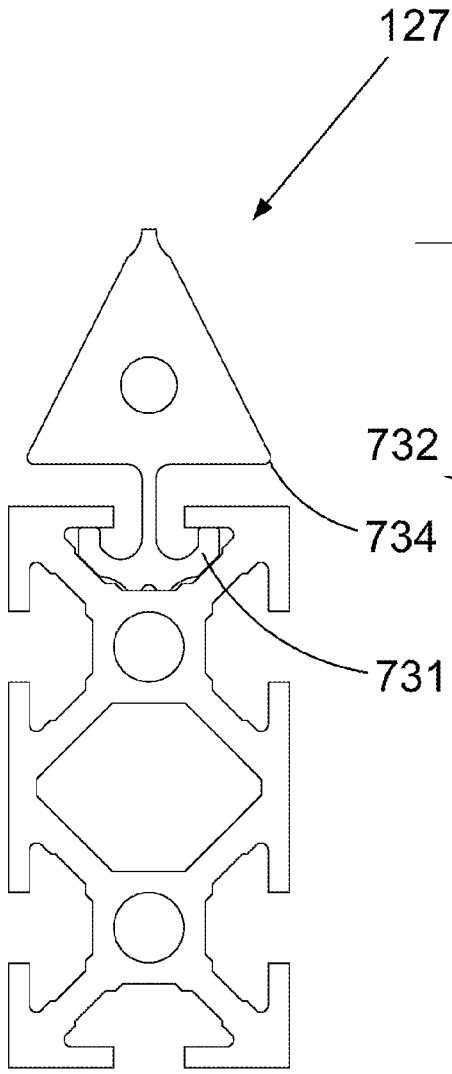
Figure 7B:
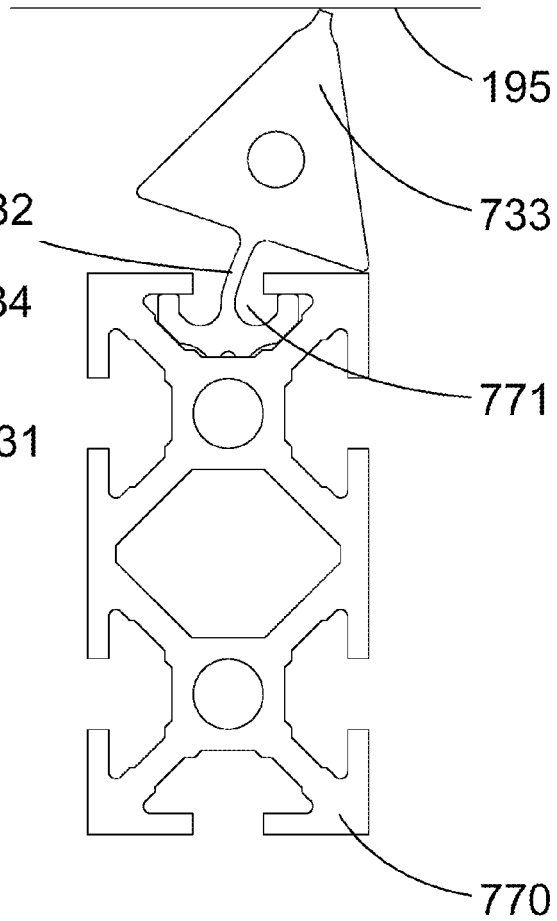

FIG. 4*b* shows a perspective view of the detail of FIG. 4A;

FIG. 5*a* shows a detail in longitudinal sectional view of a bath of the apparatus;

FIG. 5*b* corresponds with FIG. 5A and shows the actuation of brush rollers in the bath of the apparatus;

FIG. 6 shows a detail in longitudinal sectional view of a bath of an alternative apparatus according to the invention; and FIG. 7A and FIG. 7B show a cross section through a profile provided with a wiper blade in a first position of rest and a second position of use.

With the embodiment described here the device 100 comprises a first section 110 for feeding the film 195 to a second section 120 which is a cleaning section 120 and comprises a bath 121 that can be filled with a cleaning liquid. After the cleaning in the bath 121, the film 195 that has been stripped from printing ink (film 195') is dried in a third section 130 and subsequently rolled up in a fourth section 140 yielding a roll 195*b* of cleaned film 195' which is suitable for use when setting up the printing parameters when printing film.

More specifically, the device 100 comprises a frame 101. In the first section 110 the frame 101 is arranged for rotatably placing a roll 195*a* of printed film 195 that has to be stripped from printing ink.

Apart from the bath 121, the second section 120 comprises in the embodiment discussed here an auxiliary frame 150 which can be in a relatively high first position (FIG. 1B and FIG. 1C) and in a relatively low second position (FIG. 1A) at which the auxiliary frame 150 is situated in the bath 121.

The auxiliary frame 150 is provided with guide rolls 153 and rotating scraping organs 152. The guide rolls 153 determine a path of the film 195 through the auxiliary frame 150 and thus also through the bath 121. The rotating scraping organs 152 strip the printed film 195 from the printing ink, aided therewith by the cleaning liquid. Severed ink particles will end up in the cleaning liquid and can be transported by means of a pump 123 to a filter 124 after which the cleaned liquid ends up in the bath 121 again. The filter 124 is for instance a candle filter (Type VB-H-52, Firma Van Borselen, Zoetermeer, The Netherlands). The cleaning liquid is for instance Polywash 3000 (Polymount International BV, Nijkerk The Netherlands), a cleaning liquid based on 4-hydroxy-4-methylpentan-2-on. The scraping organs 152 are for instance rollers (diameter 8 cm) covered with nylon plush (Pental Eterna Brushes & Tools Making Co., Ltd., Shanghai, China). Advantageously such plush material is applied to the rollers in the shape of a band and in the shape of a spiral, thus enabling a more effective cleaning of the film 195.

When the film 195' that has been stripped from printing ink exits the bath 121, there is adhering liquid on the surface of the film 195'. This will be removed by using a pair of conventional elastomeric wiper blades 127, that are positioned on either side of the film 195' and press against the film 195' that is fed between them. In order to effectively remove the adhering liquid, the wiper blades 127 protrude to beyond the band of film 195'. Wiper blades made of EPDM rubber have been found very suitable.

The film 195' is fed along the wiper blades at an angle of 55° with the horizontal, first past the wiper blade at the upper side at a distance of 10 cm followed by a wiper blade at the lower side of the film 195'.

In the third section 130 the film 195' is dried in a drying chamber 131 using air knives 132. The film 195' is fed through the drying chamber 131 by a long path created by guide rolls 133, wherein air is fed to the drying chamber 131 by means of a fan 135. The dried film 195' is rolled up in the fourth section 140. The roll **195*b* film 195' is powered by means of a motor 141 and pulls the film 195 through the device 100**.

Figure 1A:
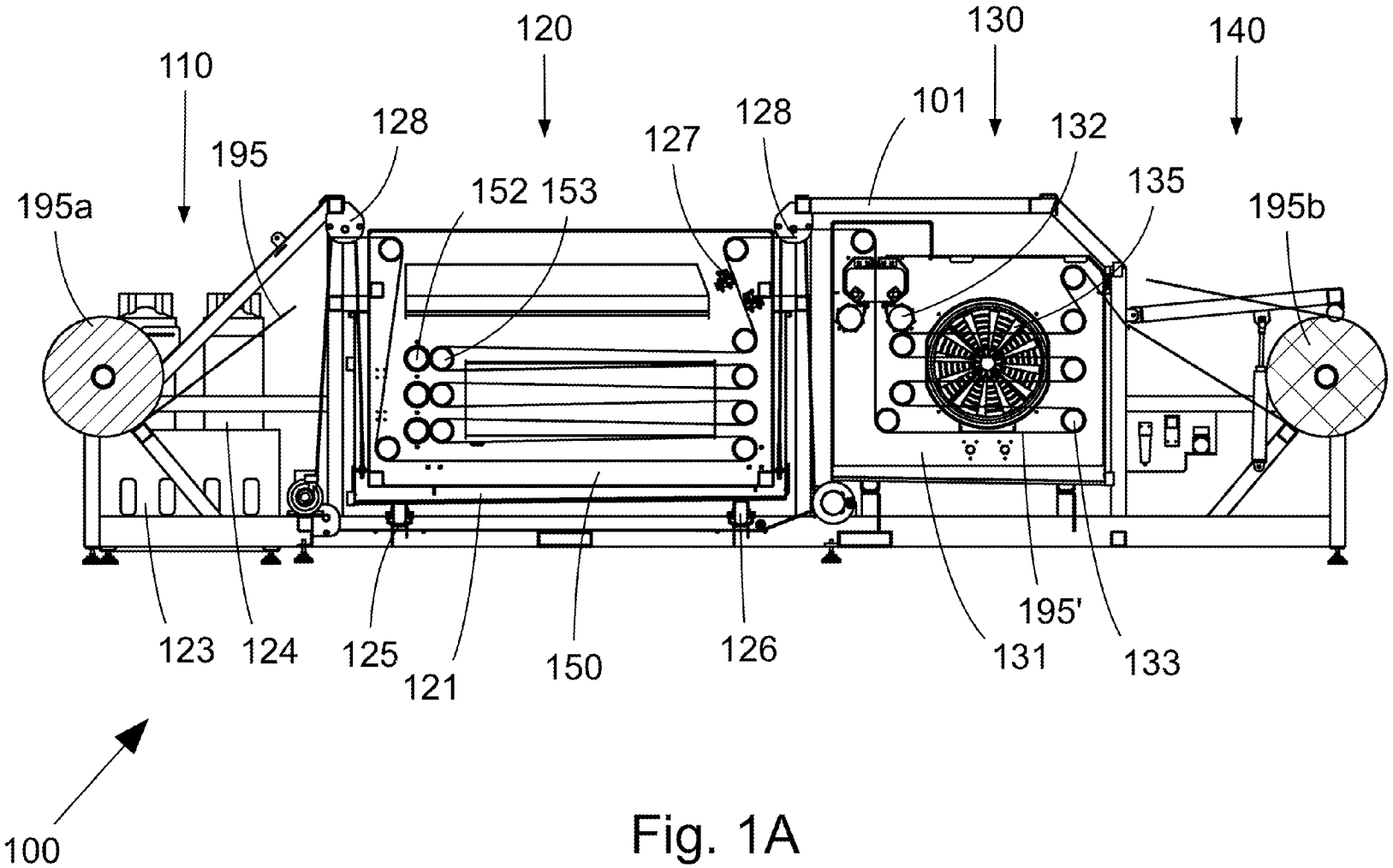

FIG. 1A also shows pulleys 128 for moving the auxiliary frame 150 from the first position to the second position and vice versa. This will be further elucidated below with reference to FIG. 4A and FIG. 4B.

Figure 1B:
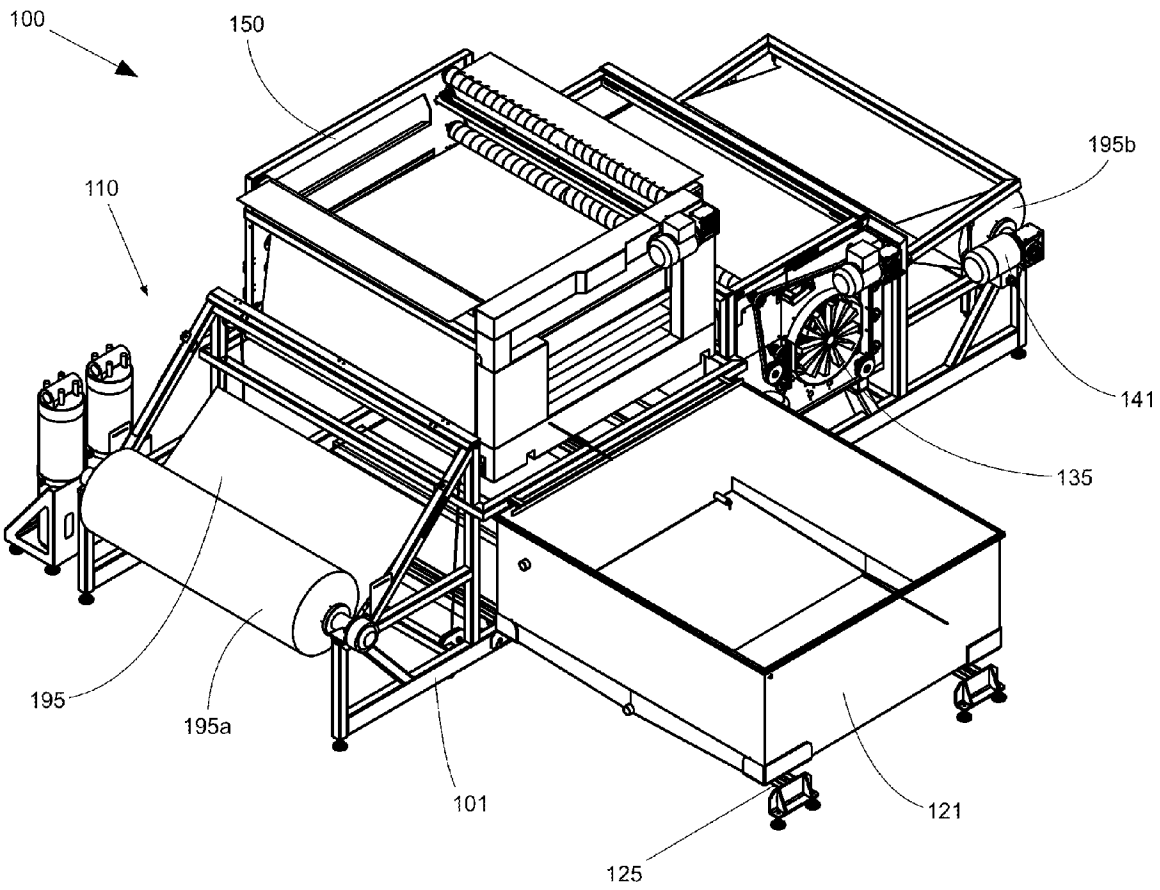

FIG. 1B shows a perspective view of the apparatus 100 of FIG. 1A, however in a state wherein the bath 121 has been rolled via rails 125 to outside the frame 101. This may e.g. be practical when cleaning the bath 121.

Furthermore, the auxiliary frame 150 is in the first relatively high position wherein the printed film 195 can readily be introduced in the auxiliary frame 150. Prior to cleaning the printed film 195, the bath 121 will be rolled under auxiliary frame 150, whereafter this will be brought toward the relatively low second position (FIG. 1A).

Figure 1C:
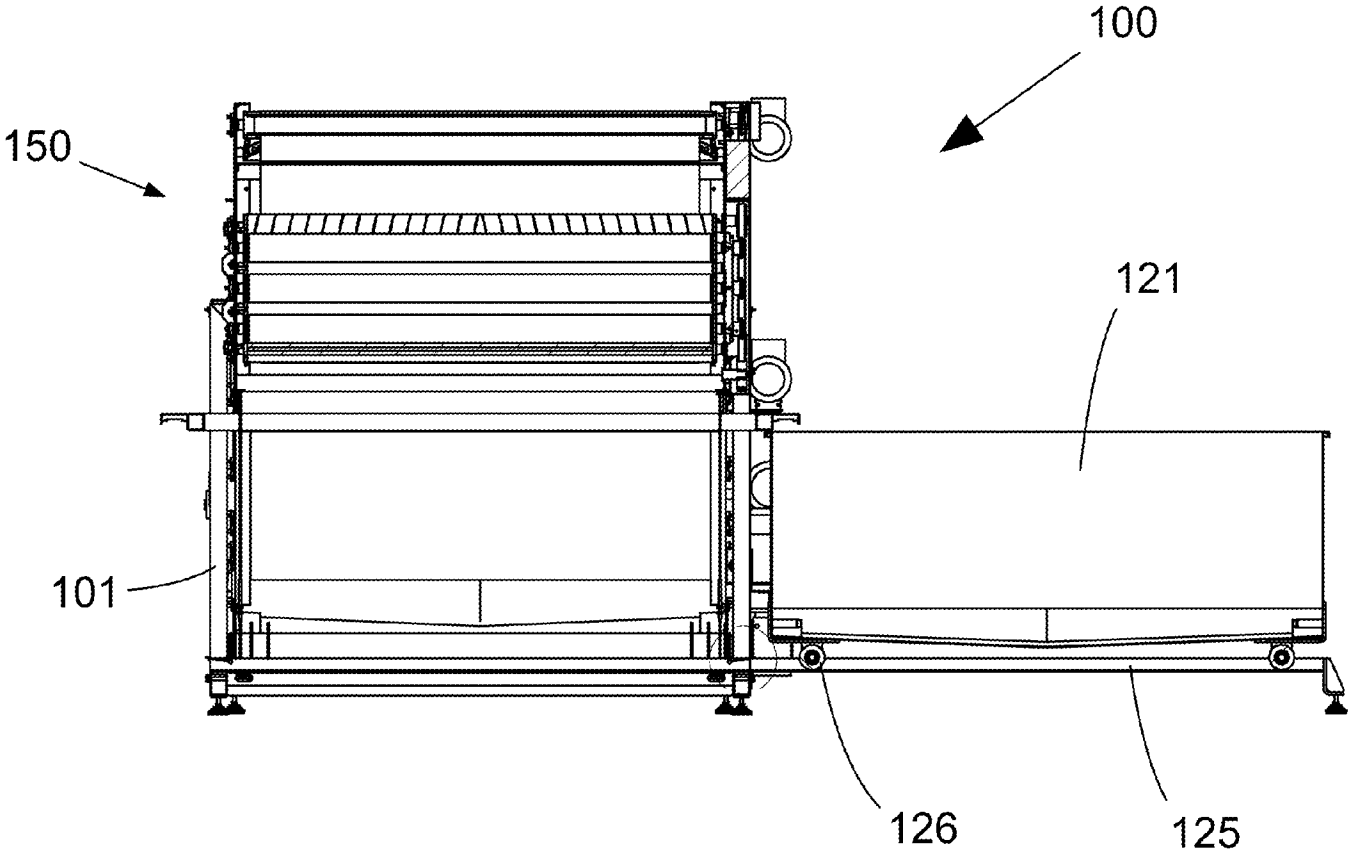

FIG. 1C shows a cross-sectional area through the apparatus 100 in the situation shown in FIG. 1B wherein the bath 121 which is provided with wheels 126 has been rolled over the rails 125 to outside the frame 101; and wherein the auxiliary frame 150 is in the relatively high first position.

Figure 2:
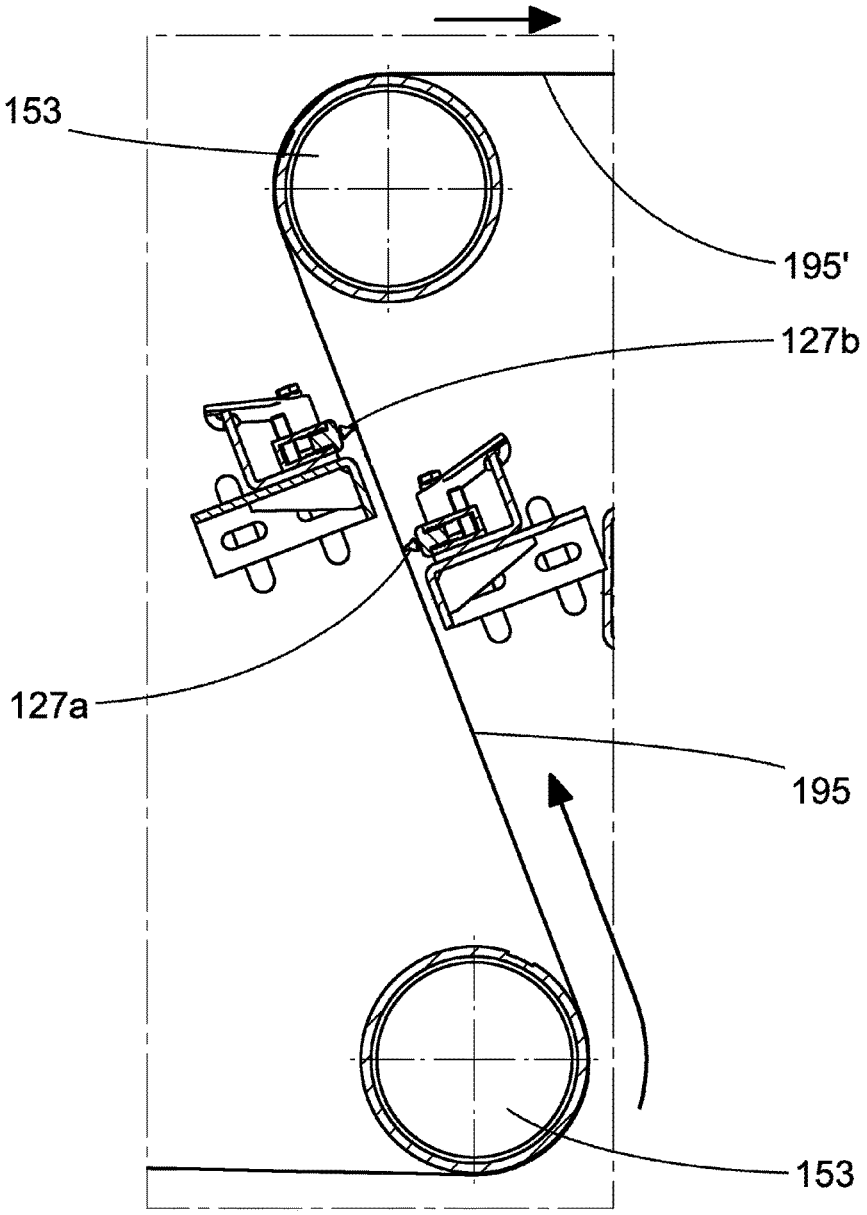
FIG. 2 shows a detail of wiper blades of the apparatus of FIG. 1A.

FIG. 2 shows a detail of the apparatus of FIG. 1A, and in particular shows a pair of wiper blades 127, between which the band of film 195' is fed when it exits the bath 121 with cleaning liquid. Thus, adhering cleaning liquid is removed from the band. Therewith however, the band of film 195' is not yet completely dry and also residual drops may be present on the band of film 195'.

Figure 3:
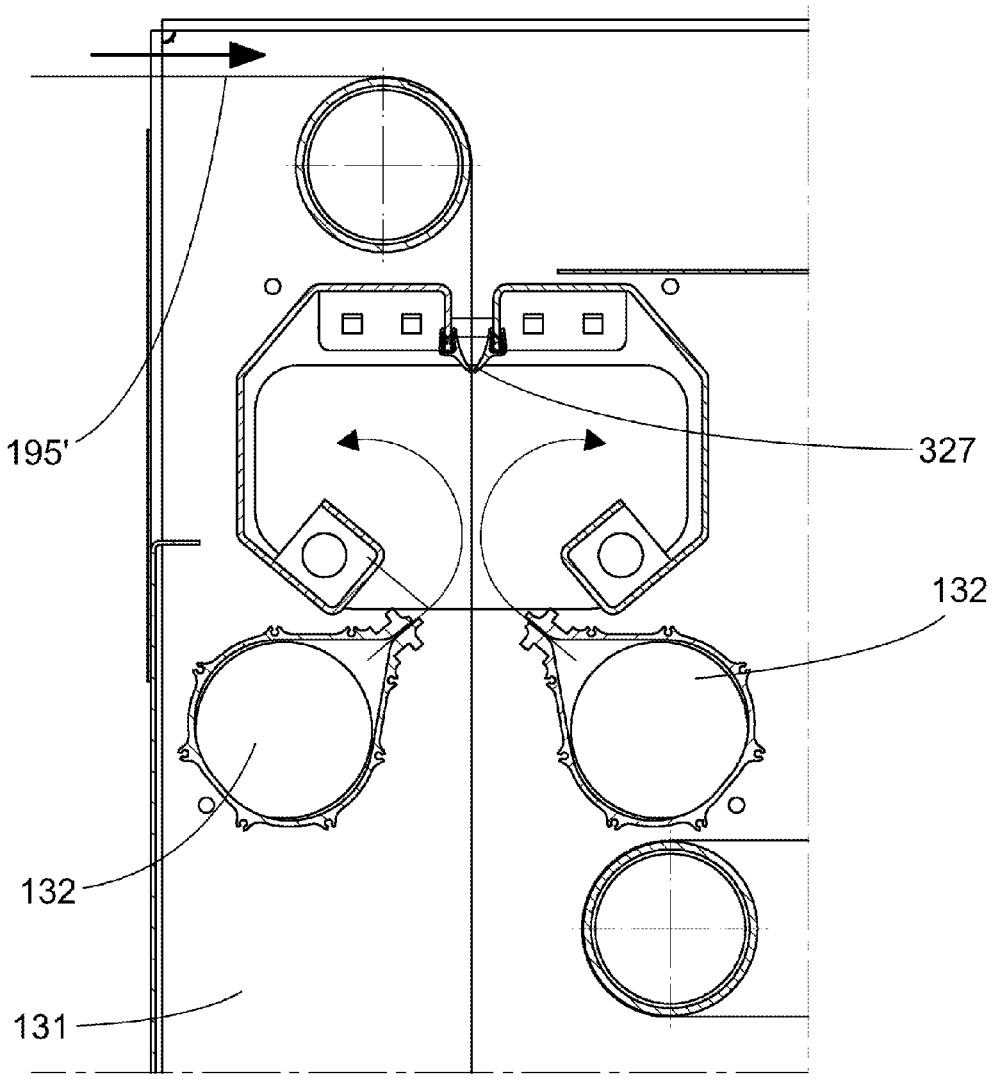
FIG. 3 shows a detail of a drying chamber of the apparatus of FIG. 1A.

FIG. 3 shows a detail of the drying chamber 131 of the apparatus 100 of FIG. 1A. The band of film 195' is guided between two wiper blades 327, which also make sure that the band of film 195' is guided between two air knives 132. The air knives 132 both block any drops of liquid and enhance the evaporation thereof. The wiper blades 327 in particular make sure that drops that are blown off the film by the air knives 132 do not end up on the film again but are guided away from the film toward troughs 328 for discharge of the removed liquid.

For moving the auxiliary frame 150 from the first position towards the second position thereof v.v., with the embodiment of the apparatus according to the invention discussed here, the auxiliary frame 150 is at the lowermost section (half) thereof provided with flexible elements 451, here in the form of cables 451. The cables 451 are attached to an axle 452 (FIG. 4B) which can be powered by a motor 453 having a right-angled transmission 454. Thereby the cables 451 are wound up on or wound off of the axle. The cables 451 are guided over pulleys 128. In this way the auxiliary frame 150 can be lifted simply and reliably (toward the first position) or it can be lowered again.

FIG. 4A reveals that the cables 451' for the opposite side of the auxiliary frame extend under the rails 125.

FIG. 5A shows a longitudinal sectional view through the bath 121 and the auxiliary frame 150 and illustrates how the printed band 195 for cleaning thereof is fed through the bath 121 of cleaning liquid 599 using guiding rolls 133.

With the present embodiment the auxiliary frame 150 comprises two parallel steel plates 551 which are provided with windows 554 for inserting the printed band 195 in the auxiliary frame 150 when this is in the relatively high first position.

FIG. 5B essentially corresponds with FIG. 5A, and illustrates the cleaning of the printed band 195 by means of guiding rolls 153 and the scraping organs 152 powered by a chain 560 provided with a chain tightener 561, guiding wheels 564, and a drive motor 562. To this end the guiding rolls 153 and the scraping organs 152 are provided with gear wheels 563, 563' that are set in rotation by the chain 560. With the embodiment described here, the drive motor 562 is governed depending on the velocity with which the motor 141 transports the band through the apparatus.

With the embodiment described here, the scraping organs 152 have been displaceably installed in a horizontal direction, and they press against the printed band 195. The gear wheels 563' of the scraping organs 152 press the chain 560 via a Teflon® plastic strip 565 against gear wheels 563 of the guiding rolls 153. More specifically the plastic strip 565 is present between the plates and against the pins of the links of the chain 560. Hereby the chain 560 effectively drives the gear wheels and the chain will not disengage from the gear wheels.

FIG. 6 largely corresponds with FIG. 5A, except that a second bath 621 is provided with an additional liquid. Additional wiper blades 627 placed downstream will hardly get dirty and clean film 195' can be obtained in a highly effective way.

The additional liquid of the second bath 621 will stay relatively clean and in case the additional liquid is cleaning liquid it can be discharged in the first bath 121. This can be done continuously or batch wise.

Advantageously however, the additional liquid is clean water as the last liquid, thus leaving less chemicals on the film.

With this embodiment the wiper blades **127*a*, 127*b* and additional wiper blades 627*a*, 627*b* are placed in the direction of transport of the film 195 for each pair at a distance of 10 cm of each other, which offers the advantage of being able to exert a relatively larger force on the film, as a result of which it can be stripped from adhering liquid effectively, yielding a qualitatively better, cleaner film 195'**.

Both pairs of wiper blades are preferably situated at a location where the film is at an angle of at least 40° with the horizontal, as a result of which gravity helps with a quick discharge of the particular liquid. The wiper blade 127*a* that strips the film at the upper side thereof from liquid is positioned upstream with respect to the wiper blade that strips the underside from liquid. Thus, liquid flowing from the side of the upper side of the film toward the underside of the film can still be removed by the wiper blade 127*b* situated (but with the contacting line thereof higher) downstream (the same applies for the additional wiper blade 627*b*).

FIG. 6 also shows an alternative cleaning organ in the form of a brush plate 680. In order to be able to effectively exert force on the film 195 a counter plate 681 is provided at the opposite side. In order to prevent damage to the film 195 this counter plate 681 may be provided with relatively short, relatively flexible brush hairs whereas the brush plate 680 is provided with relatively long, relatively inflexible brush hairs.

FIG. 7A and FIG. 7B show a cross section through a profile 770 which comprises a longitudinal groove 771 in which a wiper blade 127, 627 is received, in particular a base section 731 which is connected via a flexible but dimensionally stable neck section 732 with the wiper section 733.

When in use the wiper section 733 will be carried along by the film 195 against which the wiper blade 127, 627 is pressed causing the wiper section 733 to tilt until the wiper section 733 with a longitudinal edge 734 thereof gets into contact with profile 770. Thus a fixed angle of the wiper section 733 with respect to the film 195 is achieved.

This embodiment allows the film 195 to be fed from the other side, which may be necessary when the band of film 195 has to be coupled to a following band of film 195.

Within the scope of the claims as defined the method and apparatus can be varied in various ways by the appended claims. For example, air used for drying may be heated, for more efficient drying of the film before it is rolled up or used.

The invention claimed is:

1. A method for cleaning a printed band of flexible material, the band having two opposing side faces running between longitudinal edges, the method comprising the steps of:

contacting at least one side face of the band with a cleaning liquid, thereby wetting the side face;

removing printing ink from the band by contacting the wetted side face with a cleaning organ, yielding a cleaned band of flexible material; and removing cleaning liquid from the cleaned band of flexible material using a pair of wiper blades comprising a lower wiper blade disposed over the band and a higher wiper blade disposed under the band, wherein the wiper blades protrude to beyond the longitudinal edges of the band, by feeding the band upwardly at a non-vertical angle of at least 20° to horizontal between the wiper blades, the non-vertical feed angle causing one of the side faces to be an upper side face and the other of the side faces to be a lower side face, with the wiper blades arranged in a direction of transport of the band at a distance of at least 1 cm from one another such that the band is first fed along the lower wiper blade so as to wipe the upper side face and subsequently fed along the higher wiper blade so as to wipe the lower side face for the removal of the cleaning liquid from the band.

2. The method according to claim 1, wherein contacting the side face of the band with cleaning liquid comprises feeding the printed band through a bath containing cleaning liquid.

3. The method according to claim 1, further comprising: rolling up the cleaned band after removing the cleaning liquid.

4. The method according to claim 1, wherein the cleaning organ is a rotating scraper and there is a speed difference between the printed band and the scraper.

5. The method according to claim 4, wherein the throughput speed of the band is coupled to the circumferential speed of the rotating scraper.

6. The method according to claim 1, further comprising:

after removal of the cleaning liquid using wiper blades, contacting the side face of the band with additional liquid, thereby again wetting the side face; and removing additional liquid from the band using an additional pair of wiper blades comprising a lower additional wiper blade disposed over the band and a higher additional wiper blade disposed under the band, wherein the additional wiper blades protrude to beyond the longitudinal edges of the band, by feeding the band upwardly at a second non-vertical angle of at least 20° to horizontal between the additional wiper blades, the second non-vertical feed angle causing one of the side faces to be an upper side face and the other of the side faces to be a lower side face, with the additional wiper blades arranged in the direction of transport of the band at a distance of at least 1 cm from one another such that the band is first fed along the lower additional wiper blade so as to additionally wipe the upper side face and subsequently fed along the higher additional wiper blade so as to additionally wipe the lower side face, for the removal of the additional liquid from the band.

7. The method according to claim 6, wherein the additional liquid is at least 96 v/v % water.

8. The method according to claim 1, wherein the non-vertical feed angle is at most 87° to horizontal.

9. The method according to claim 1, further comprising:

after the removal of the cleaning liquid, drying the band with forced air.

10. The method according claim 1, further comprising:

after the removal of the cleaning liquid, printing on the band.

11. Device for cleaning a printed band of flexible material, the band having two opposing side faces running between longitudinal edges, comprising:

a frame;

a motor supported by the frame for passing the printed band through the device such that cleaning liquid wets at least one side face;

a cleaning organ supported by the frame in contact with the wetted printed band for removing printing ink from at least one side face of the wetted printed band to obtain a cleaned band; and a pair of wiper blades for the removal of the cleaning liquid, the pair of wiper blades comprising a lower wiper blade disposed over the band and a higher wiper blade disposed under the band, wherein the wiper blades are arranged at both side faces of the band and protrude to beyond the longitudinal edges of the band, are situated at a location where the band is fed upwardly at a non-vertical angle of at least 20° to horizontal between the wiper blades, the non-vertical feed angle causing one of the side faces to be an upper side face and the other of the side faces to be a lower side face, and are arranged in the direction of transport of the band at a distance of at least 1 cm from one another such that the band can first be fed along the lower wiper blade so as to wipe the upper side face and subsequently fed along the higher wiper blade so as to wipe the lower side face.

12. Device according to claim 11, further comprising an air knife for drying, downstream of the pair of wiper blades, of the cleaned band.

13. Device according to claim 11, further comprising a bath supported by the frame for cleaning liquid.

14. Device according to claim 11, further comprising a roll supported by the frame for rolling up the cleaned band after removing the cleaning liquid.

15. Device according to claim 11, wherein the cleaning organ is a rotating scraper.

16. Device according to claim 11, further comprising a lower additional wiper blade disposed over the band and a higher additional wiper blade disposed under the band, situated at a location where the band is fed upwardly at a non-vertical additional angle of at least 20° to horizontal between the additional wiper blades, the non-vertical additional feed angle causing one of the side faces to be an upper side face and the other of the side faces to be a lower side face, the additional wiper blades being arranged in the direction of transport of the band at a distance of at least 1 cm from one another such that the band is first fed along the lower additional wiper blade so as to wipe the upper side face and subsequently fed along the higher additional wiper blade so as to wipe the lower side face.

17. Device according to claim 11, wherein the non-vertical feed angle is at most 87° to horizontal.

18. Device according to claim 11, further comprising a fan supported by the frame for forcing air onto the cleaned band after the removal of the cleaning liquid for drying the band.

* * * * *